US009708807B2

(12) United States Patent
Miskovich

(10) Patent No.: US 9,708,807 B2
(45) Date of Patent: Jul. 18, 2017

(54) WATER TRANSFER DEVICE FOR UNDERGROUND WATER COLLECTION AND STORAGE CHAMBERS

(76) Inventor: Joseph S. Miskovich, Fenton, MI (US)

( * ) Notice: Subject to any disclaimer, the term of this patent is extended or adjusted under 35 U.S.C. 154(b) by 794 days.

(21) Appl. No.: 13/135,581

(22) Filed: Jul. 9, 2011

(65) Prior Publication Data

US 2013/0008841 A1 Jan. 10, 2013

(51) Int. Cl.
*E02B 11/00* (2006.01)
*E03F 1/00* (2006.01)

(52) U.S. Cl.
CPC ..... *E03F 1/003* (2013.01)

(58) Field of Classification Search
USPC ..... 405/51, 43–49
See application file for complete search history.

(56) References Cited

U.S. PATENT DOCUMENTS 1,529,019 A * 3/1925 Evans ..... 137/592
2,527,046 A * 10/1950 Wold ..... 405/40
4,745,801 A * 5/1988 Luzier ..... 73/152.23
4,919,568 A * 4/1990 Hurley ..... 405/43
5,087,151 A * 2/1992 DiTullio ..... 405/43
5,241,979 A * 9/1993 Chang ..... 137/247.41
5,322,387 A * 6/1994 Heine et al. ..... 405/36
5,445,730 A * 8/1995 Pattee ..... 210/167.31
5,890,838 A * 4/1999 Moore et al. ..... 405/49
6,062,767 A * 5/2000 Kizhnerman et al. ..... 405/39
6,132,139 A * 10/2000 Hashimoto et al. ..... 405/104
6,379,541 B1 * 4/2002 Nicholas ..... 210/155
6,383,372 B1 * 5/2002 Houck et al. ..... 210/150
7,226,241 B2 * 6/2007 DiTullio ..... 405/46
7,744,756 B2 * 6/2010 Davis, Jr. ..... 210/170.08
7,806,627 B2 * 10/2010 DiTullio ..... 405/49
7,887,256 B2 * 2/2011 Miskovich ..... 405/49
8,147,688 B2 * 4/2012 Adams et al. ..... 210/170.03
2003/0070977 A1 * 4/2003 Anderson ..... 210/301
2004/0184884 A1 * 9/2004 DiTullio ..... 405/43
2004/0253054 A1 * 12/2004 Atchley ..... 405/36
2006/0076056 A1 * 4/2006 Schmitt et al. ..... 137/216
2006/0233612 A1 * 10/2006 DiTullio ..... 405/46
2007/0258770 A1 * 11/2007 Miskovich ..... 405/43
2008/0035547 A1 * 2/2008 Miller ..... 210/205
2008/0181725 A1 * 7/2008 Miskovich ..... 405/49
2009/0180834 A1 * 7/2009 Hedstrom et al. ..... 405/43
2009/0261036 A1 * 10/2009 Lucas ..... 210/602
2010/0059430 A1 * 3/2010 Adams et al. ..... 210/170.03

* cited by examiner

*Primary Examiner* — Amber Anderson
*Assistant Examiner* — Patrick Lambe
(74) *Attorney, Agent, or Firm* — Young Basile Hanlon & MacFarlane, P.C.

(57) ABSTRACT

An underground water collection and transfer system using a primary and secondary water storage chambers. At least one of the water transfer inlets is angled and positioned lower than the outlet into the secondary storage chambers.

17 Claims, 32 Drawing Sheets

WATER TRANSFER DEVICE FOR UNDERGROUND WATER COLLECTION AND STORAGE CHAMBERS

FIELD OF INVENTION

The present invention relates to underground water collection and storage chamber systems and more particularly, to water transfer devices such as transfer devices from a primary water collection and storage chamber to a secondary water collection and storage chamber.

BACKGROUND

In recent years there has been a strong development of various storm water control systems to address the issues of stormwater runoff quantity and quality. One development has been the use of sub-surface water collection and storage chamber systems designed to retain stormwater surface flows and in particular, allow for a much slower discharge of stormwater effluents into receiving waters. Many of these systems are designed so there is a primary receiving chamber and several secondary chambers that line up end to end under impervious surfaces such as paved parking lots.

Arch shaped underground water collection and storage chambers are highly preferable to other types of underground water management systems. Unlike some other types of underground water management devices, arch shaped water collection and storage chamber systems are better equipped to be located under paved areas. These systems receive surface water, typically from wet weather events through surface drains into one or more primary water collection and storage chamber. These primary chambers are usually connected to a series of secondary water collection and storage chambers by a straight transfer device between the side wall of the primary chamber and an end wall of a secondary chamber. Usually these connecting pipes are approximately halfway up the wall of the chambers and are designed to transfer water from the primary chamber when the amount of water from the surface drain is such that drainage from the primary chamber is slower than the intake of the volume of surface flow. The transfer devices act as an overflow bypass mechanism and the transferred water accumulates in the secondary systems until the surface drainage ceases. At that time the secondary chambers either drain into the soils below if they are pervious, or in the case of impervious soils, drain out of a secondary drainage pipe into a secondary drainage system. In some cases the drainage water might be held for other uses such as, for example, irrigation.

One of the problems with these systems is that by utilizing a straight pipe as a water transfer device the water from the primary chamber passes to the secondary chamber with all of the debris, sediments and other pollutants that were washed off of the surface by the wet weather flow. These secondary chambers then accumulate this debris, sediments, and other pollutants throughout the system making maintenance expensive and time consuming. In many cases these pollutants can result in the failure of the system due to clogging and sediment buildup requiring removal of the surface material such as a parking lot in order to replace them. There is a clear need for water transfer devices that can minimize the transfer of debris and sediments and other pollutants from the primary chamber to the secondary chamber thus allowing the primary system to retain the debris and sediments and drastically reducing maintenance cost and time of the system.

BRIEF SUMMARY OF THE INVENTION

Disclosed herein are several new and novel water transfer devices for moving excess surface water from a primary water collection and storage chamber into a secondary water collection and storage chambers. In the preferred embodiment the transfer devices would be pipes where the inlet of the pipe is 8" to 10" above the floor of the primary water collection and storage system and rise vertically to a point approximately half way to the top of the primary chamber. At that location in the preferred embodiment the transfer device would turn 90° and pass through the wall of the primary water collection and storage chamber and cross over to and through the end wall of a secondary water collection and storage system where the water would be discharged. In one embodiment the 90° angled water transfer device might be a pipe 4-6" in diameter. In a preferred embodiment the entrance to the water transfer device might contain a filter or a screen for preventing course debris sediment and/or other pollutants from entering the water transfer device from the primary water collection and storage chamber. As the primary water collection and storage chamber begins to fill with water draining into it from a surface drain, the water would rise within the primary chamber and upwards through the inlet of the water transfer device until it reaches the 90° angle of the water transfer device. At this point the water would then flow horizontally into a secondary water collection and storage chamber until such times as the receiving primary water collection and storage chamber ceases to receive surface water and the quantity of the water decreases thus stopping the flow to the secondary water collection and storage chamber. Floating debris in the primary chamber would not be able to enter the water transfer device pipe since the inlet of the water transfer device intake would be below the surface water level in the primary chamber. In one embodiment the transfer device might be a separate angled transfer device connected to a straight transfer device that passes from the primary underground water collection and storage chamber to the secondary underground water collection and storage chamber.

The primary water collection and storage chamber could include one or more of the angled water transfer devices, with each device connecting to a separate secondary water collection and storage chamber. In some embodiments the angled water transfer devices inlet openings in the primary water collection and storage chamber might be at varying heights above the floor in order to control which secondary water collection and storage chamber would receive the first flow of water from the primary water collection and storage chamber. With the use of varying inlet heights the user could predetermine which secondary water collection and storage chamber would receive overflow from the primary chamber first.

In some embodiments the inlet of the angled water transfer device might contain a filter media designed to remove pollutants such as sediment from the water. The filter media could be comprised of a media material that could remove other pollutants such as hydrocarbons, metals or other selected pollutants, depending on the desired use.

In one embodiment the facing inlet of the water transfer device in the primary chamber might be angled horizontally within the primary chamber and downstream preventing the flow from entering directly into the water transfer device. In one embodiment the water transfer device would be paired with a higher secondary transfer pipe to allow for bypass in heavy flows. This might allow for the transfer of the first flush of drained surface water in the primary chamber to filter through the first transfer that might contain media, a screening component, or both. The secondary higher elevated bypass water transfer pipe would prevent a back up of the entire primary chamber in very heavy rain falls and thus flooding on the surface.

In some embodiments the water transfer device might contain a spring trap device that prevents the water flow from traveling back into the primary chamber from the secondary chamber when the primary chamber's water level declines. The water in the secondary chamber would then drain slowly through the pervious floor, or out a secondary drain or be stored for other uses such as irrigation. In an alternative embodiment, the transfer pipe might include a trap door mechanism on its bottom which upon accumulation of a predetermined load would open and drop sediment and other debris into an area below the water transfer device between the primary and secondary chambers.

Accordingly, the objects of the present invention are to provide novel and improved apparatus and methods for water transfer devices such as, for example, water transfer pipes for use in underground stormwater collection and storage chamber systems.

BRIEF DESCRIPTION OF THE DRAWINGS

Embodiments or variations of the water collection and storage system storage devices are described by way of example with reference to the accompanying drawings.

DETAILED DESCRIPTION

Figure 1:
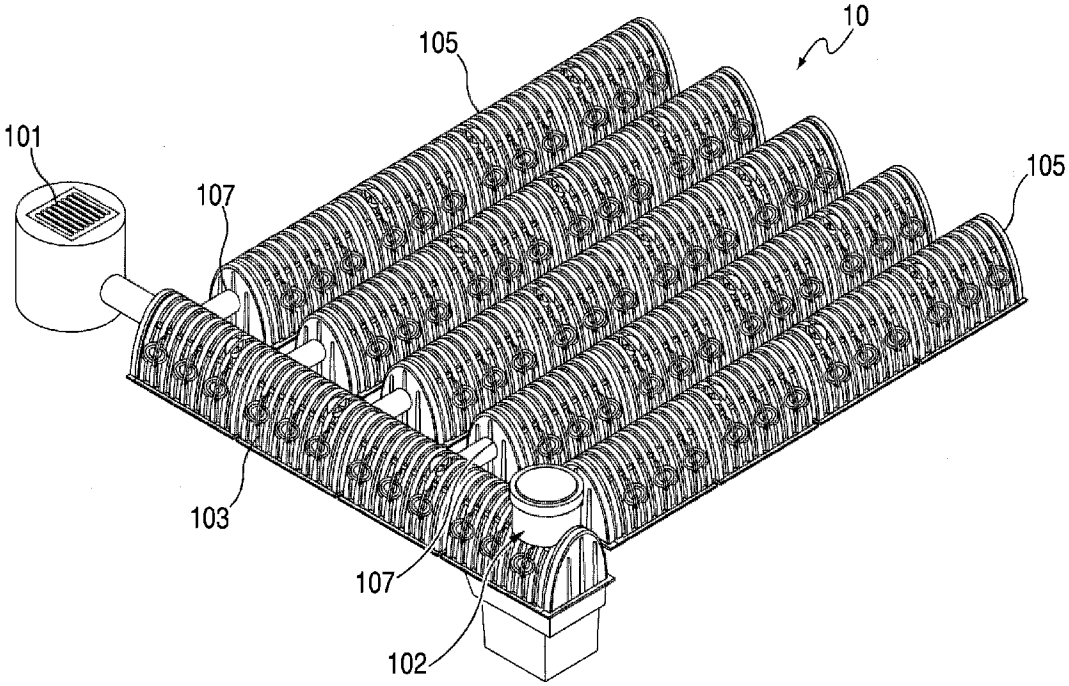
FIG. 1 shows a schematic of an underground surface water collection and storage system.

In the drawings, reference numeral 10 generally denotes an exemplary embodiment of a water transfer device underground chamber system such as, for example, a water transfer pipe between underground water collection and storage chambers. Any device however, could be utilized, for transferring water between the primary underground water collection and storage chamber and secondary underground water collection and storage chamber. For example, FIGS. 2*b* and *c* shows an alternative water transfer device which is a scaled down chamber design 111 that is transferring the water between the primary underground water collection and storage chamber and a secondary underground water collection and storage chamber. While the preferred embodiment of the disclosures contained herein are pipes, any method of a water transfer device could be utilized. FIG. 1 shows an example of an underground water collection and storage system wherein the water drains from the surface through a surface drain 101 into a primary underground water collection and storage chamber 103 having a longitudinal axis 104. Several other secondary underground water collection and storage chambers 105 are connected to the primary chamber through transfer devices 107 to allow water flow to drain into the secondary chambers from the primary chambers when needed. The exemplary transfer devices 107 include an elongate pipe having an axis 110. Maintenance of the primary chamber may be provided through an access port not shown in FIG. 1 in the primary chamber 103.

Figure 2A:
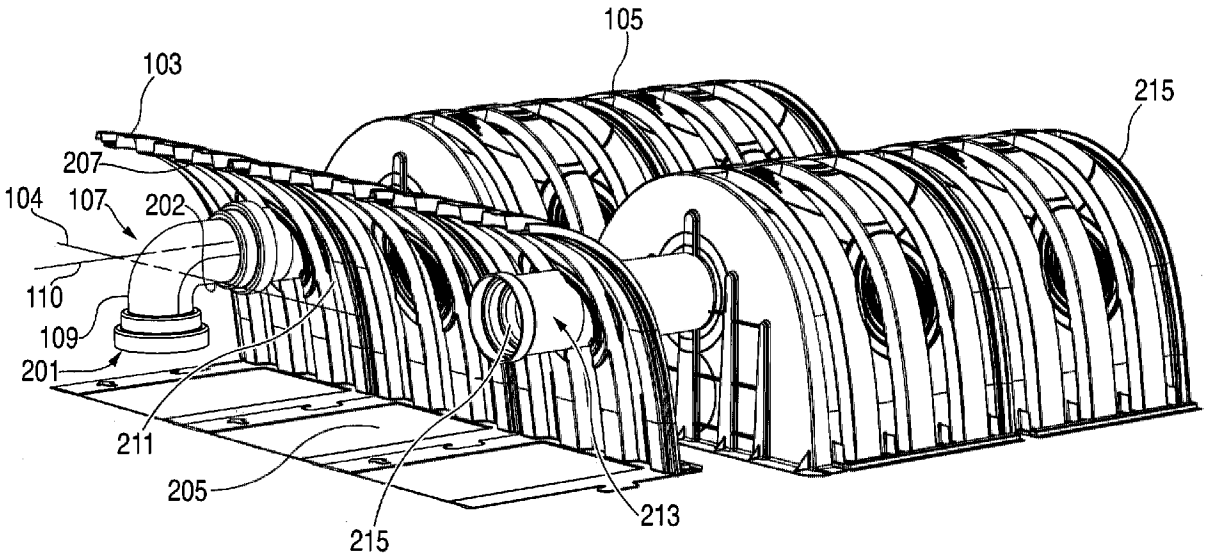
FIG. 2*a* shows a cutaway view of a primary underground surface water collection and storage chamber with a 90° angled water transfer device and a straight transfer device connected to the secondary water collection and storage chambers.
Figure 2B:
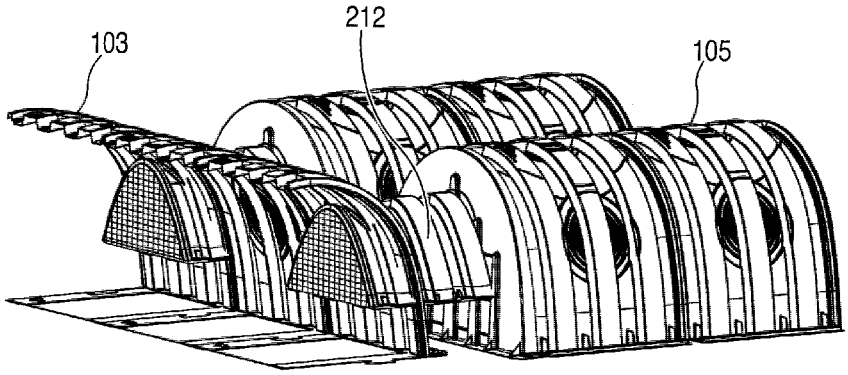
FIGS. 2*b* and *c* show an example of an alternative water transfer device connecting a primary underground surface water collection and storage chamber with secondary water collection and storage chambers.
Figure 2C:
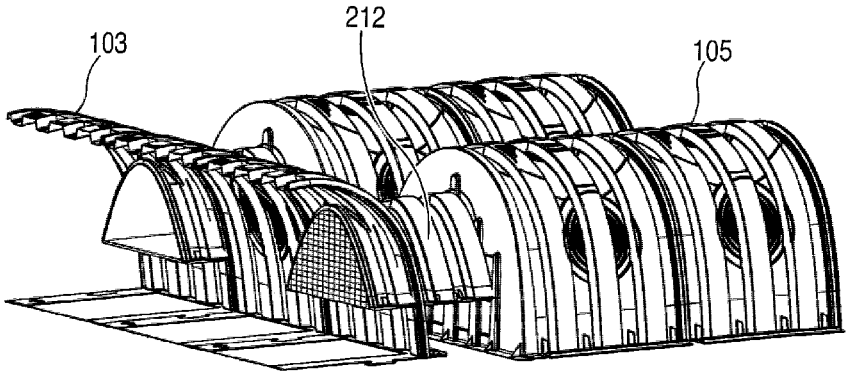
Figure 3:
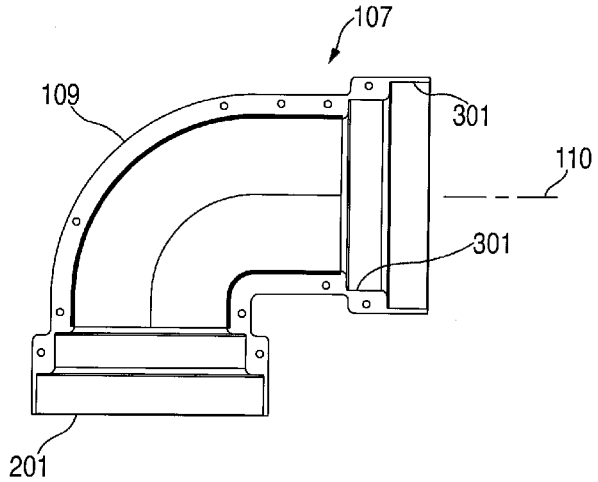
FIG. 3 shows a 90° angled water transfer device with varying opening sizes for accepting different size water transfer pipes at its outlet and varying opening sizes for filter media.

FIG. 2*a* depicts a preferred embodiment of the water transfer device having an inlet end angled inlet water 109 which is oriented at a 90° relative to the pipe elongate axis 110. The inlet opening 201 of the water transfer device 107 located inside the primary water collection and storage chamber 103 is shown in a horizontal position with the inlet plane opening parallel with the floor of the chamber 205. The 90° angled water transfer device 107 rises vertically from its inlet towards the ceiling of the primary chamber 207, and at a point approximately one half of the way towards the chamber ceiling the transfer device is turned 90° 109 towards the inside wall 211 of the primary underground water collection and storage chamber 103. The water transfer device 107 exits the primary chamber 103 through the side wall 211 and crosses over to a secondary underground water collection and storage chamber 105 where the water transfer device outlet drains into a secondary underground water collection and storage chamber. While in the preferred embodiment the angle of the transfer device 90°, any angle could be utilized that would place the inlet 201 of the transfer device below the level of the bottom 202 of the water transfer device. In a preferred embodiment a 90° angled water transfer device 107 might include a screen or filter at its inlet 201 within the primary underground water collection and storage chamber 103. As shown in FIG. 2*a* a second straight water transfer or bypass device 213 might be included that has an inlet opening 215 without a 90° turn in the primary chamber 103 which acts as a bypass for the 90° angled water transfer device 107 and allows excess water contained in the primary underground water collection and storage chamber 103 to drain directly into a second underground water collection and storage chamber 215 located next to the first secondary chamber 105. In one embodiment this secondary bypass transfer device 213 might have a screen at the inlet 215 (not shown). FIG. 3 shows an example of a cutaway of a 90° angled water transfer device 109 which has variable openings at its outlet 301 to accommodate attaching it to different transfer device sizes, for example 6, 8, or 10 inch pipes.

Figure 4:
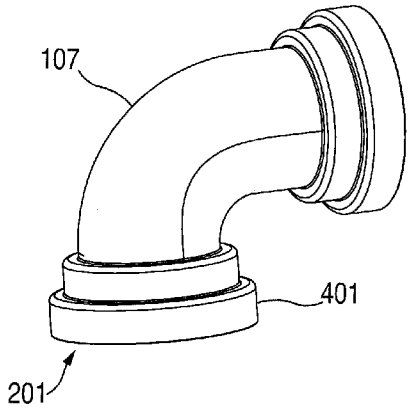
FIGS. 4 *a-d* shows various examples of a 90° angled water transfer device.
Figure 4A:
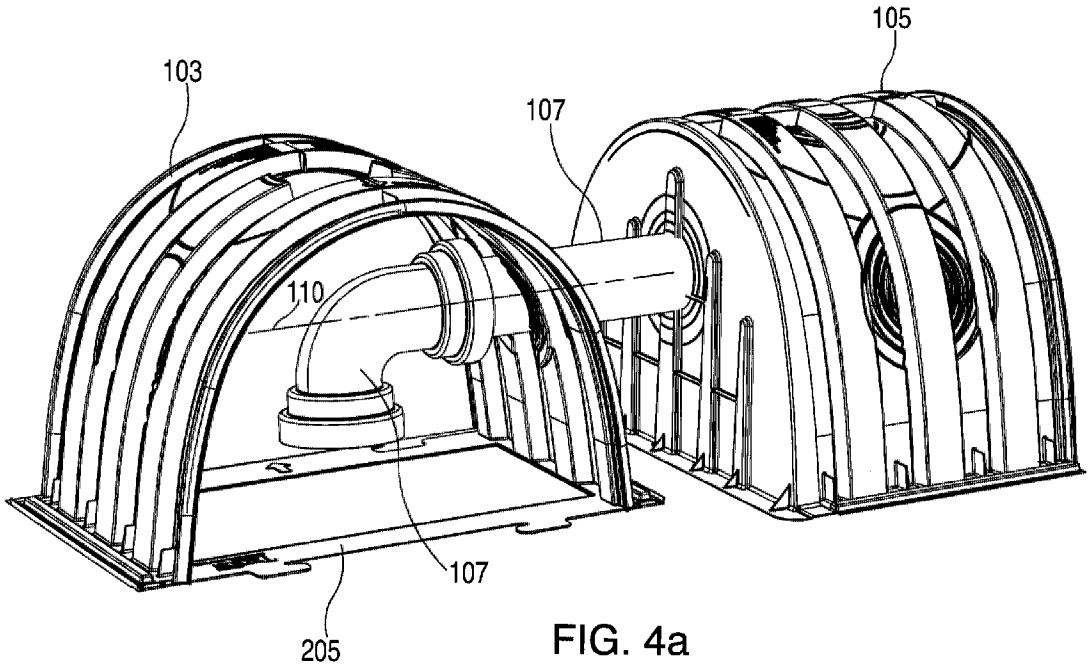
Figure 4B:
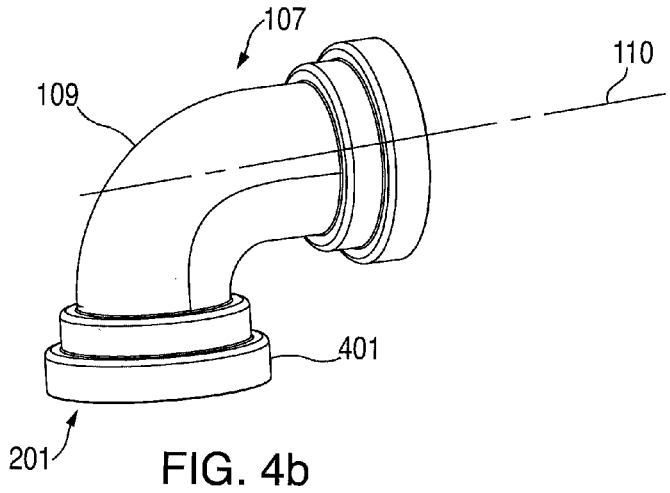
Figure 4C:
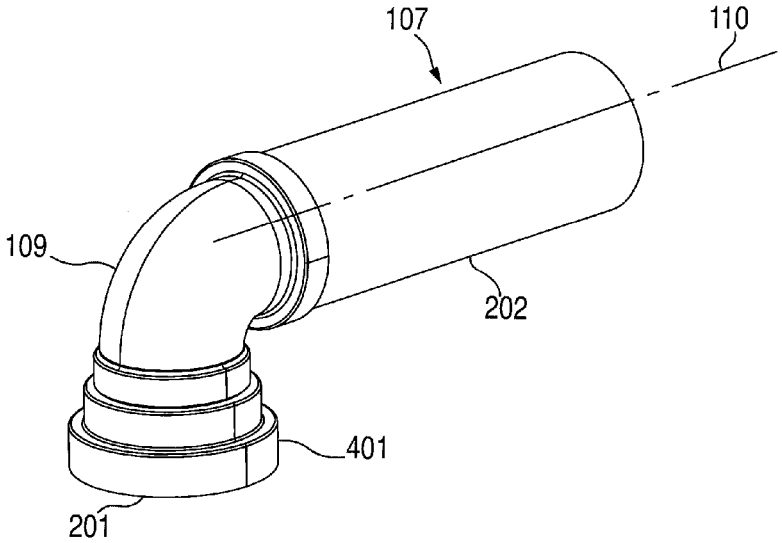
Figure 4D:
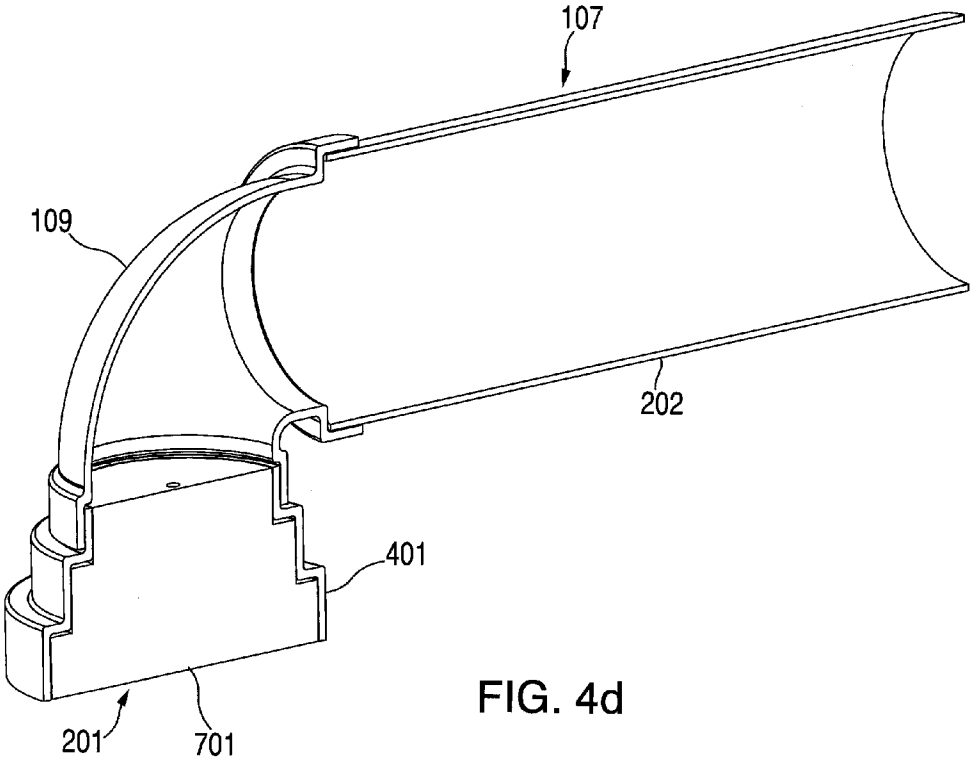
Figure 5:
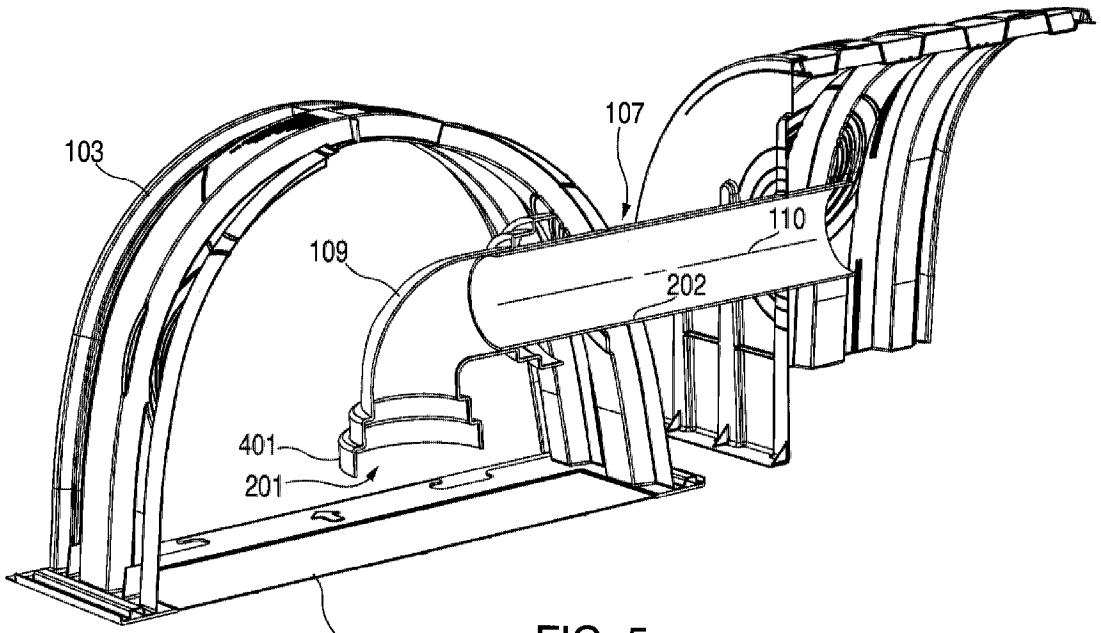
FIG. 5 shows a side view of a 90° angled water transfer device in a primary underground water collection and storage chamber.

Shown in FIGS. 4A-D, and 6 the inlet opening 201 of a 90° angled water transfer device in the primary underground water collection and storage chamber 103 might include a filter or screen containing component 401 as shown in FIG. 4. In one embodiment this component might be removable for maintenance such as cleaning and/or replacing filter media. FIG. 5 shows a filter or screen containment component 401 connected to the inlet end 201 of the 90° angled water transfer device 107.

Figure 6:
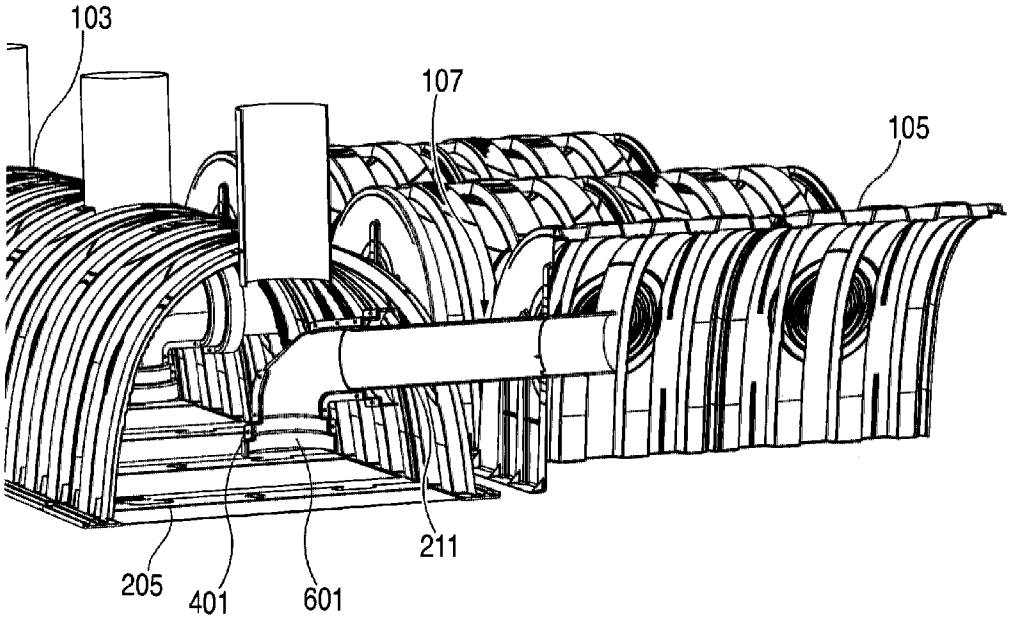
FIG. 6 shows a cutaway side view of a primary underground water collection and storage chamber with a 90° angled water transfer device.

FIG. 6 shows a cutaway of a 90° angled water transfer device 107 including a variable size filter or screen containment component 401. In a preferred embodiment the opening 601 to the transfer filter might be 8-9" above the floor 205 of the primary water collection and storage chamber. In an alternative embodiment the opening 601 might be 312" above the floor. The opening 601 could be any distance sufficient to allow rising water to flow through an inlet opening at a level below the distance where the transfer device 107 passes through the side wall of the primary underground water collection and storage chamber 211 towards and into the secondary underground water collection and storage chamber 105.

Figure 7:
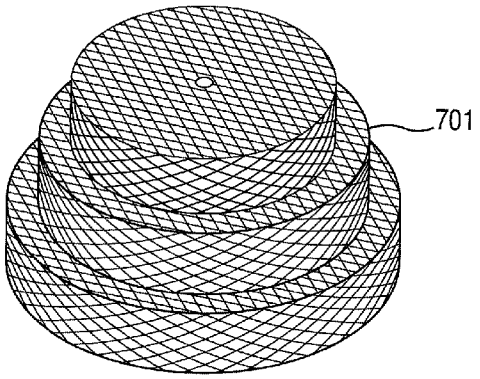
FIG. 7 shows an example of a filter media cartridge for a 90° angled water transfer device.
Figure 8:
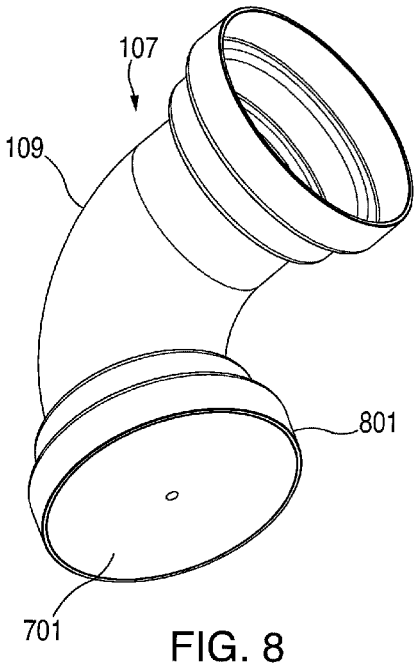
FIG. 8 shows a filter media cartridge contained within the inlet of a 90° angled water transfer device.
Figure 9:
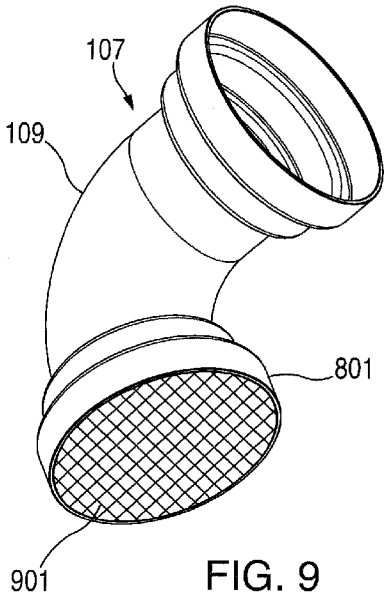
FIG. 9 shows an example of a screen contained within the inlet of a 90° angled water transfer device.
Figure 10:
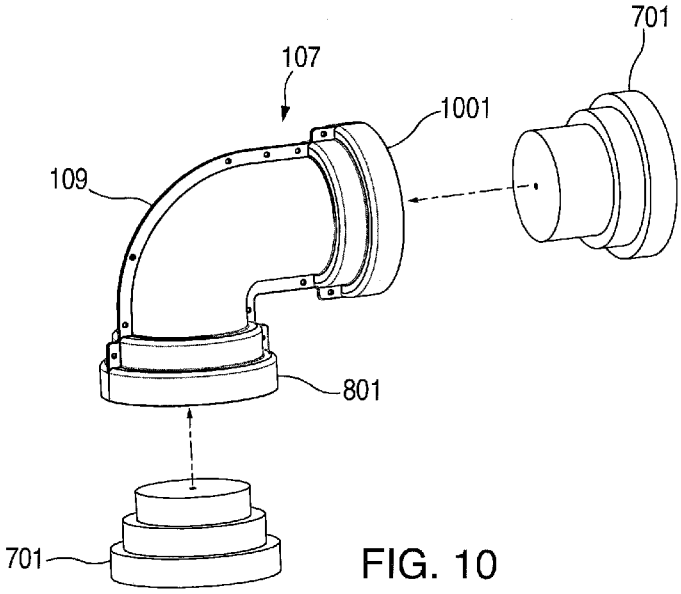
FIG. 10 shows a 90°, angled transit device filter fitting with a deep filter component at its outlet and at its inlet.
Figure 11:
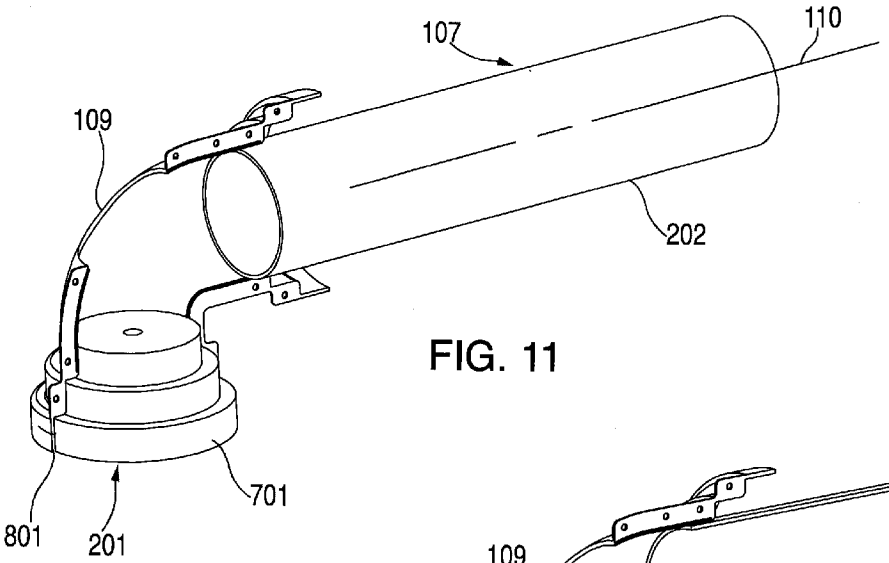
FIG. 11 shows a perspective of a 90° angled water transfer device with a cutaway view of a filter at its inlet.
Figure 12:
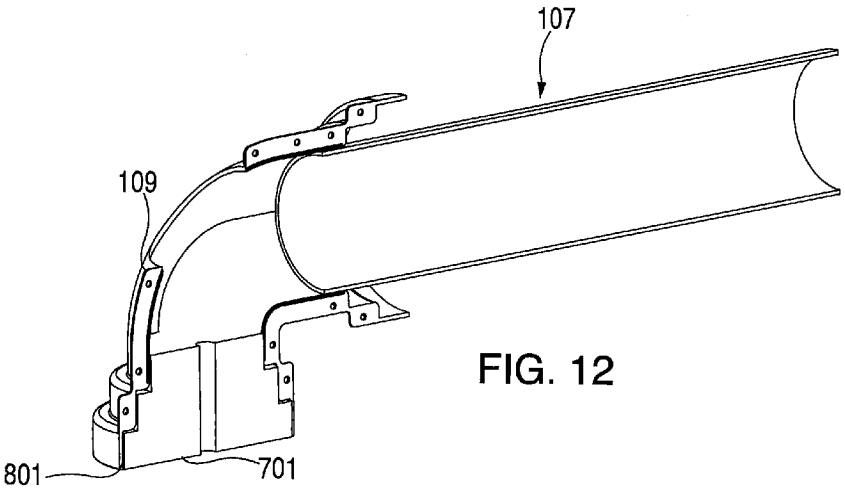
FIG. 12 shows a cutaway of a side view of a 90° angled water transfer device containing filter media.

FIG. 7 shows an example of a filter cartridge 701 that might be inserted into the inlet end 801 of a water transfer device 107 as shown in FIG. 8. FIG. 9 shows an alternative embodiment where the 90° angled water transfer device 109 might contain a screen 901 at its inlet end 801. FIG. 10 shows an example of an alternative embodiment where a filter media 701 might be placed in the outlet 1001 of the 90° angled water transfer device 109. In one variation there might be a filter in the inlet 801 and the outlet 1001. FIGS. 11 and 12 show different perspectives of the 90° angled water transfer device, 109 with a filter 701 at its inlet end 801.

Figure 13:
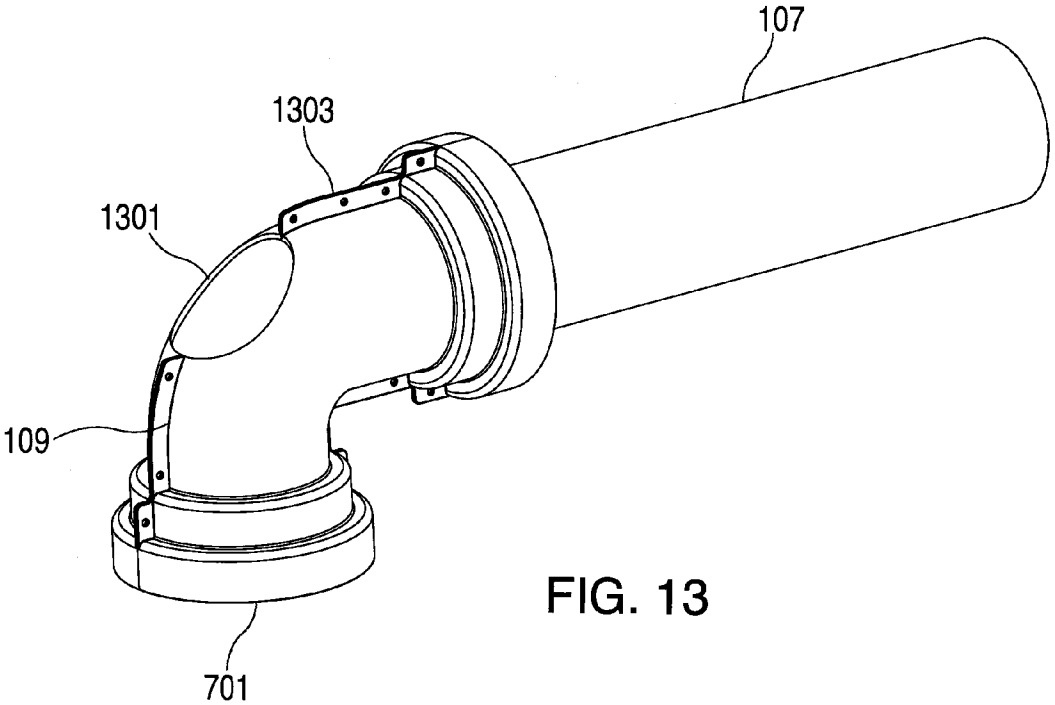
FIG. 13 shows the inlet portion of a 90° angled water transfer device with a bypass opening.
Figure 14:
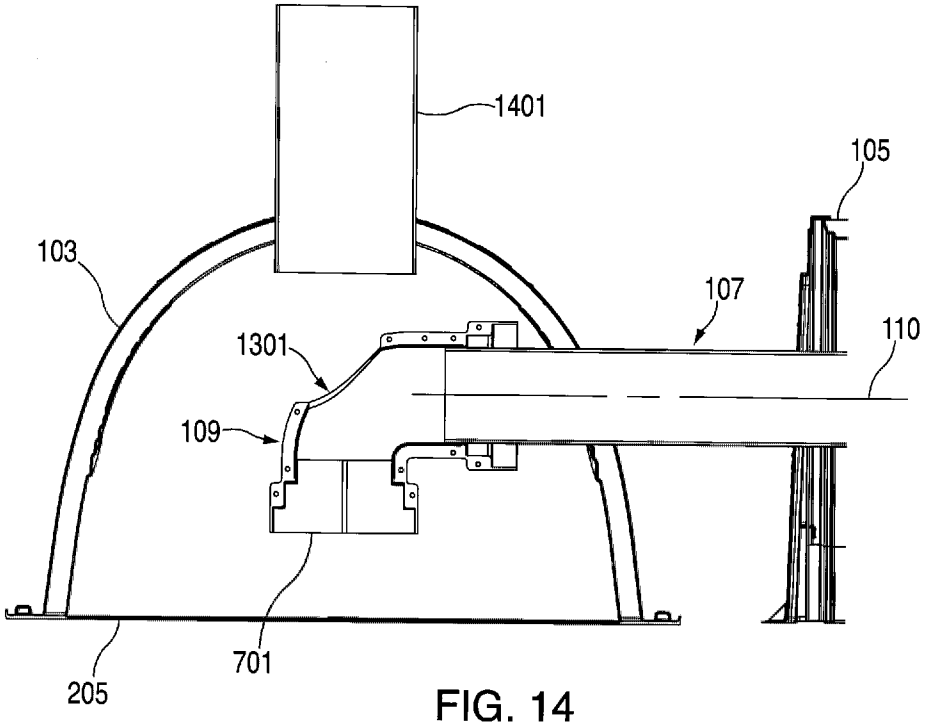
FIG. 14 shows a cutaway of a 90° angled water transfer device with a bypass going from a primary underground water collection and storage chamber into a secondary water collection and storage chamber.
Figure 15:
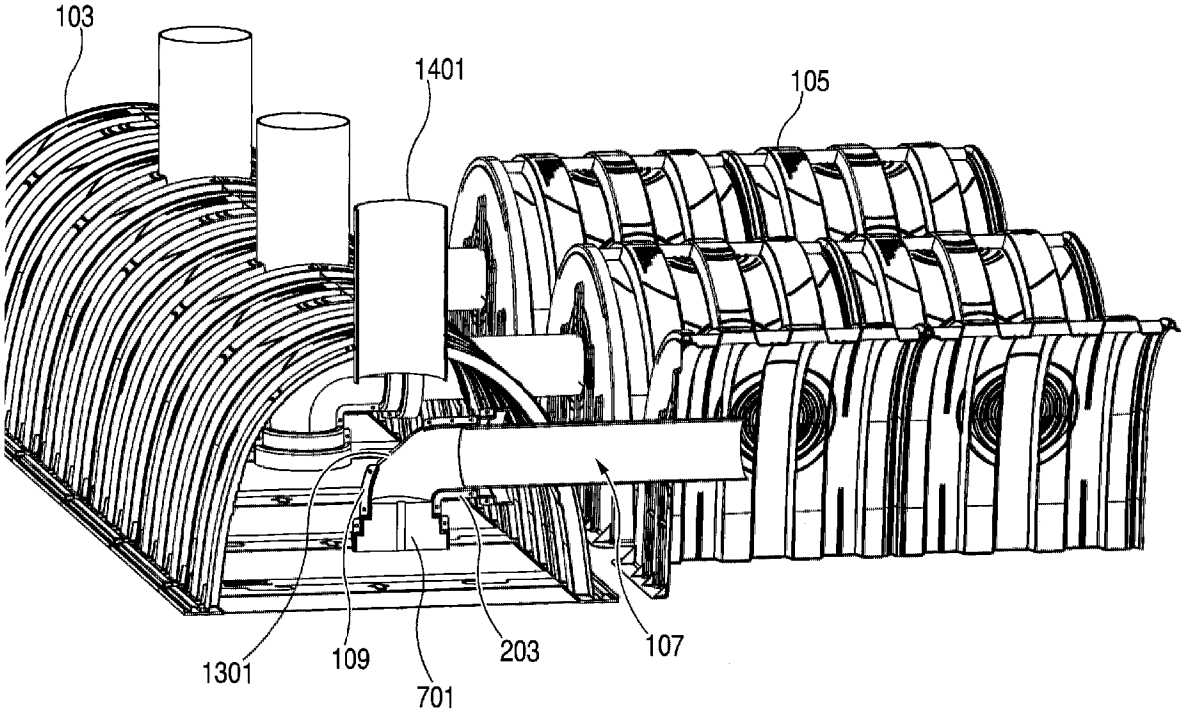
FIG. 15 shows a primary underground water collection and storage chamber connected to a secondary water and storage chamber by a 90° angled water transfer device with surface access ports.

As shown in FIG. 13 in an alternative embodiment, a 90° angled water transfer device 109 with a filter cartridge 701 might include an opening 1301 at its top 1303 to allow flow to bypass the filters 701 and flow directly into the 90° angled water transfer device 109 and into the secondary underground water collection and storage chamber 105. This would prevent a backup in the primary underground water collection and storage system 103 which could result in surface flooding. FIGS. 14 and 15 show a 90° angled water transfer device 109 placed within the primary underground water collection and storage chamber 103 with a bypass opening 1301 and a surface access port 1401.

Figure 16:
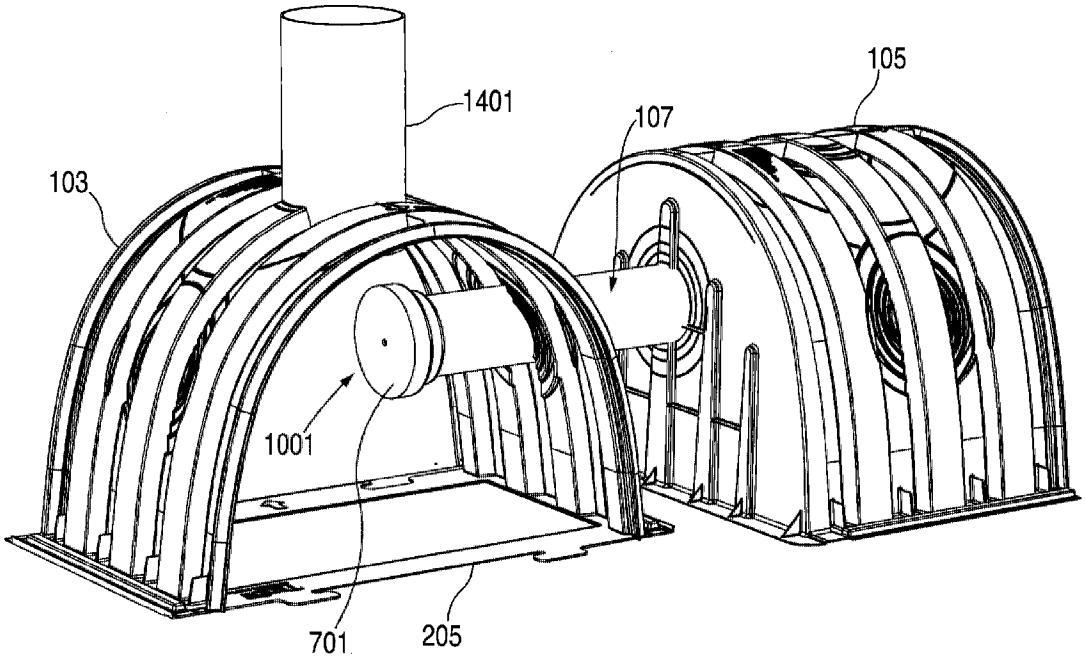
FIG. 16 shows a sectional view of a primary water collection and storage chamber with a straight transfer device coming through its side with a media filter at its inlet.
Figure 17:
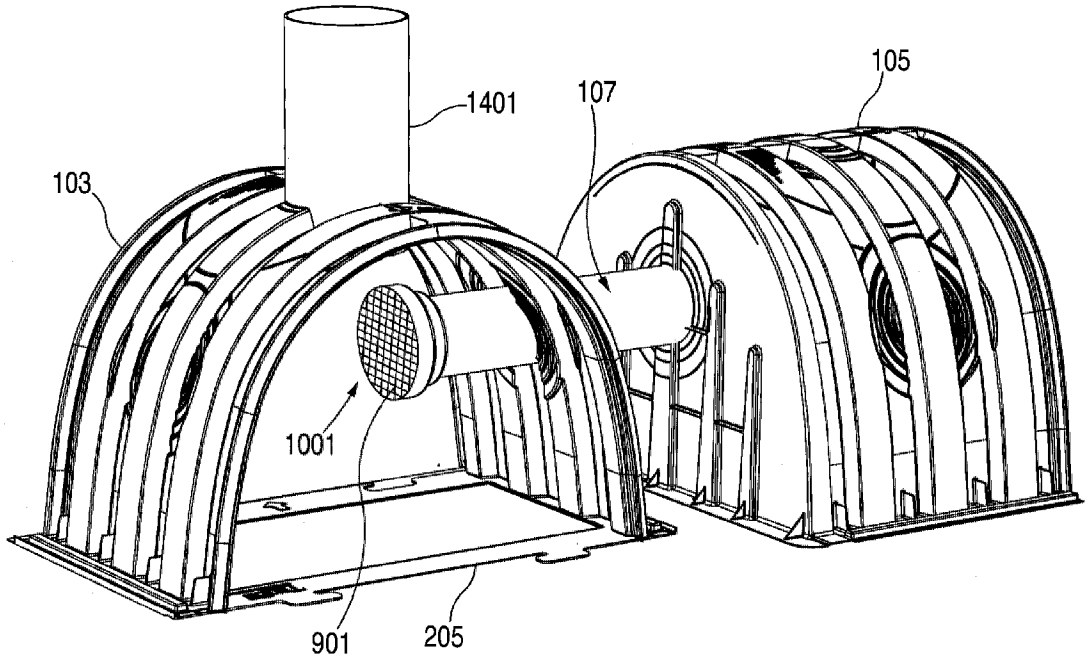
FIG. 17 shows a sectional view of a primary water collection and storage chamber with a straight transfer device coming through its side with a screen at its inlet.

As best shown in FIG. 16, in an alternative embodiment the transfer device 107 might have an inlet opening without a bend 1001 that is configured to contain a media filter cartridge 701 without a bend in the transfer device 107 as shown in FIG. 16, or a screen 901 as shown in FIG. 17.

Figure 18:
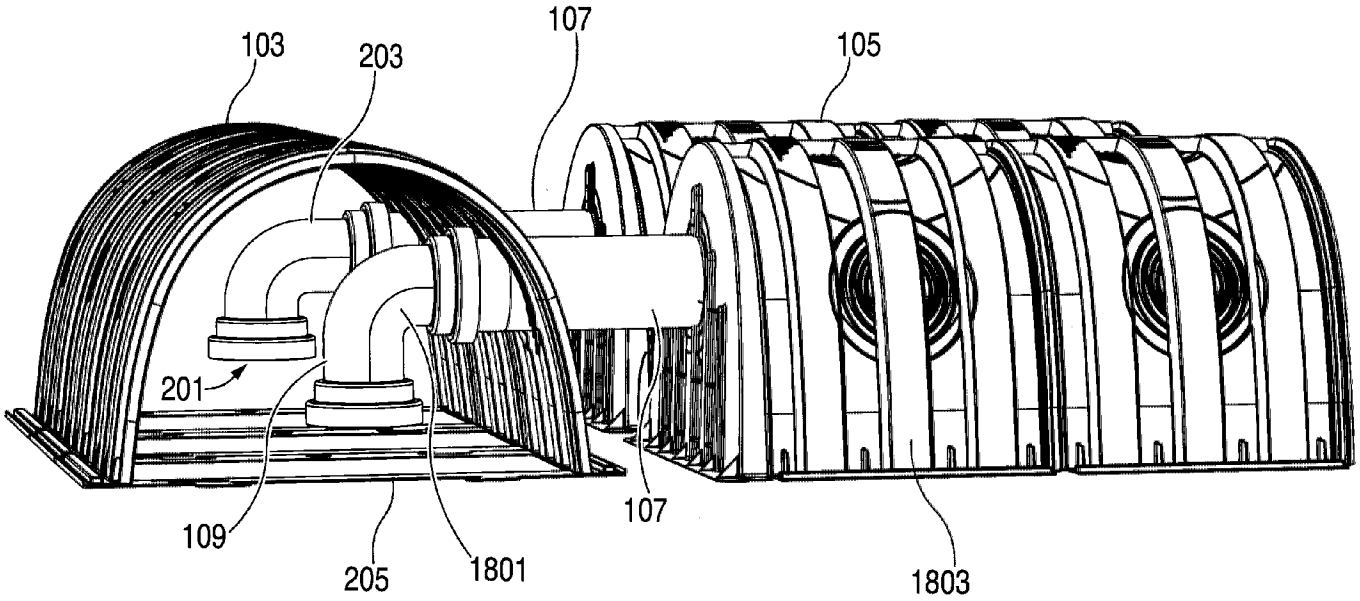
FIG. 18 shows two water transfer devices of varying heights at their inlet openings going from a primary underground water collection and storage chamber into respective secondary underground water collection and storage chambers.

Referring to FIG. 18, in one embodiment the inlet openings 201 of the 90° angled water transfer devices 109 might be at two varying heights above the floor 205 of the primary underground water collection and storage chamber 103. In one embodiment the 90° angled water transfer device 109 most distant 1801 from the surface drain 101 (FIG. 1) would be lower towards the bottom 205 allowing for the secondary collection and storage of water in the most downstream underground water collection and storage chamber 1803 first.

Figure 19:
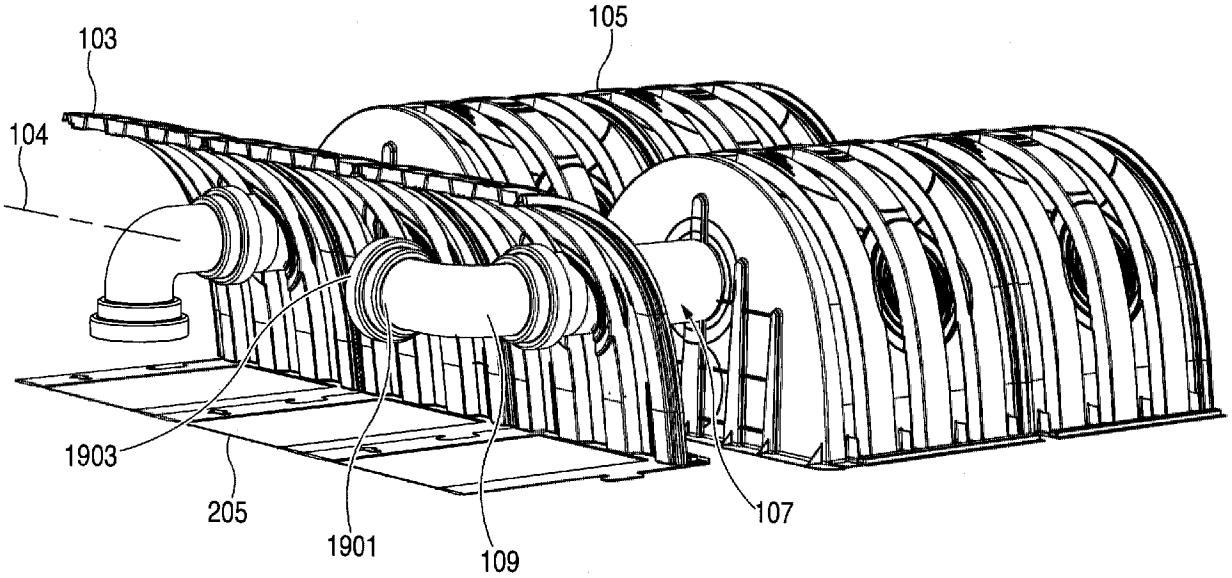
FIG. 19 shows a 90° angled water transfer device facing the bottom of the primary underground water collection and storage chamber and a second bypass 90° angled water transfer device facing downstream.
Figure 20:
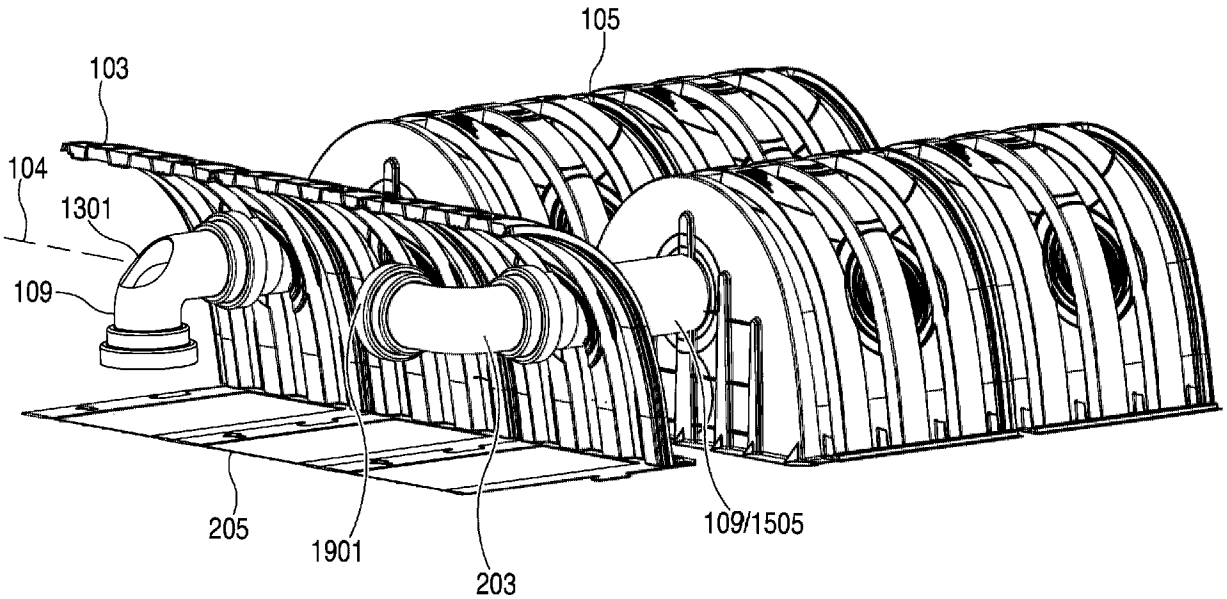
FIG. 20 shows a 90° angled water transfer device with a bypass facing the bottom of the primary underground water collection and storage chamber and a second bypass 90° angled water transfer device facing downstream.
Figure 21:
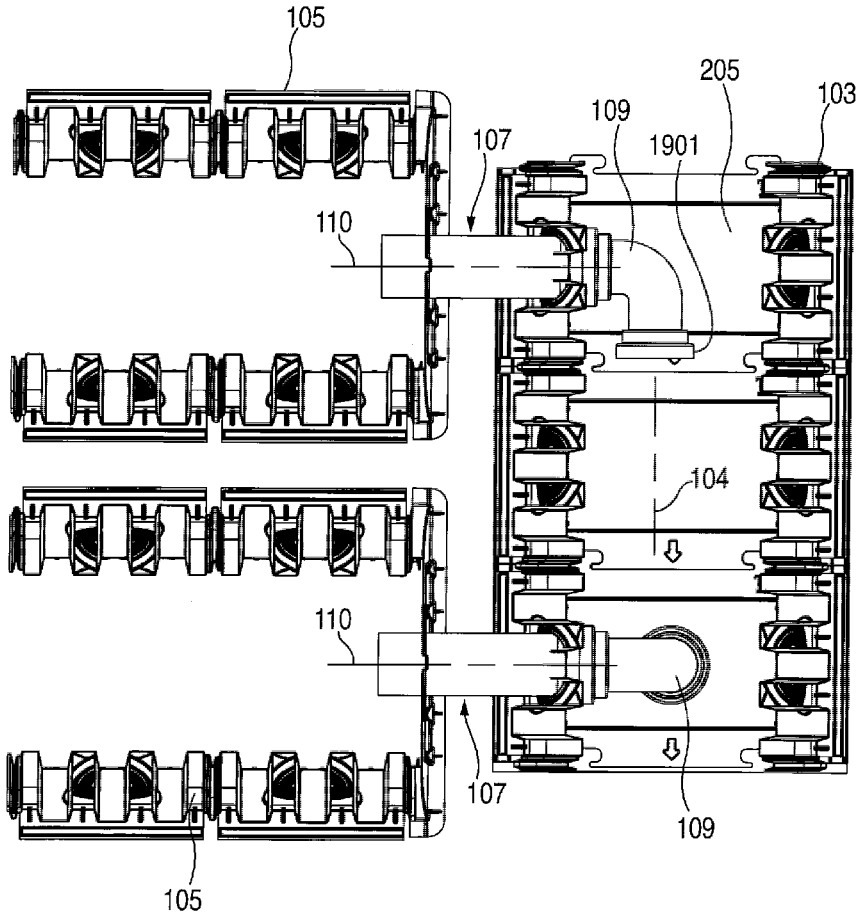
FIG. 21 shows a top view of the angled water transfer device system.

FIG. 19 depicts an alternative embodiment where one of the 90° angled water transfer devices 109, for example the downstream transfer device 109/1505 has an inlet 1903 that faces upstream toward surface inlet 101 rather than downwards toward the floor 205 of the primary underground water collection and storage chamber 103. This would allow the downstream 90° angled water transfer device 1901 to function as a bypass for an upstream 90° angled water transfer device 109 with a filter 701 or screen 901 with high flow to prevent flooding from back up on the surface. FIG. 20 shows a pair of 90° angled devices 109 with one 90° angled water transfer device inlet facing downstream 1901, and a second 90° angled water transfer device 109 that faces the floor 205 of the primary underground water collection and storage chamber 103 with a bypass opening 1301. In an alternative embodiment, the downstream transfer device 1505 might face downstream (rotated 1800 not shown). Alternately, might face upwards towards the ceiling 207 of the primary chamber 103. FIG. 21 shows a top view of a pair of 90° angled water transfer device system 107 with one transfer device inlets 1901 facing downstream.

Figure 22:
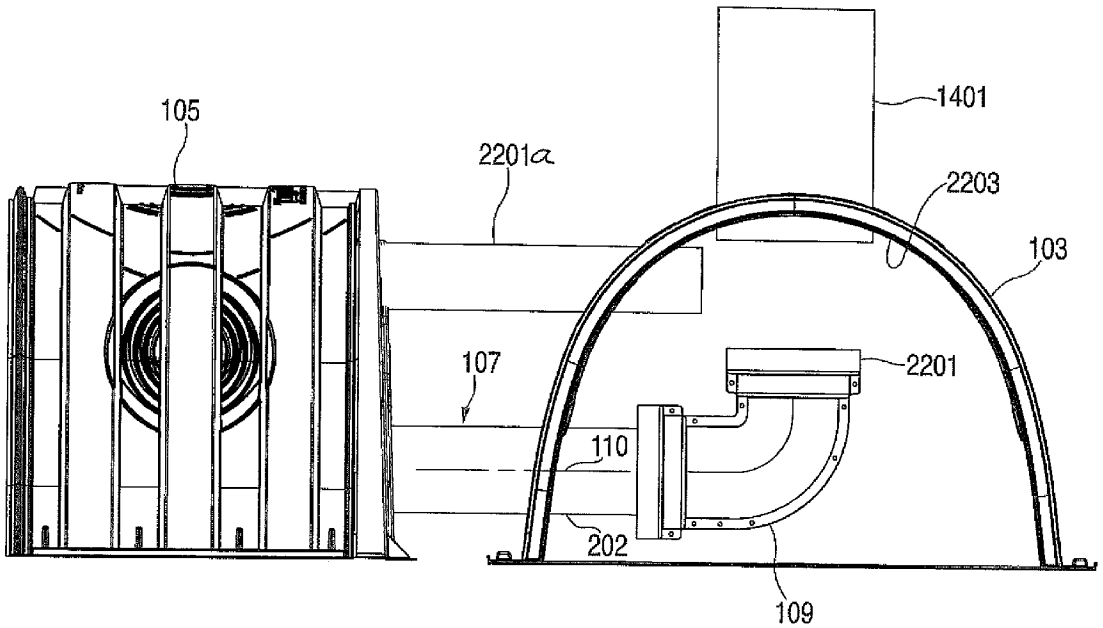
FIG. 22 shows an angled water transfer device facing upwards towards the ceiling of the primary underground water collection and storage chamber with a surface access port.
Figure 23:
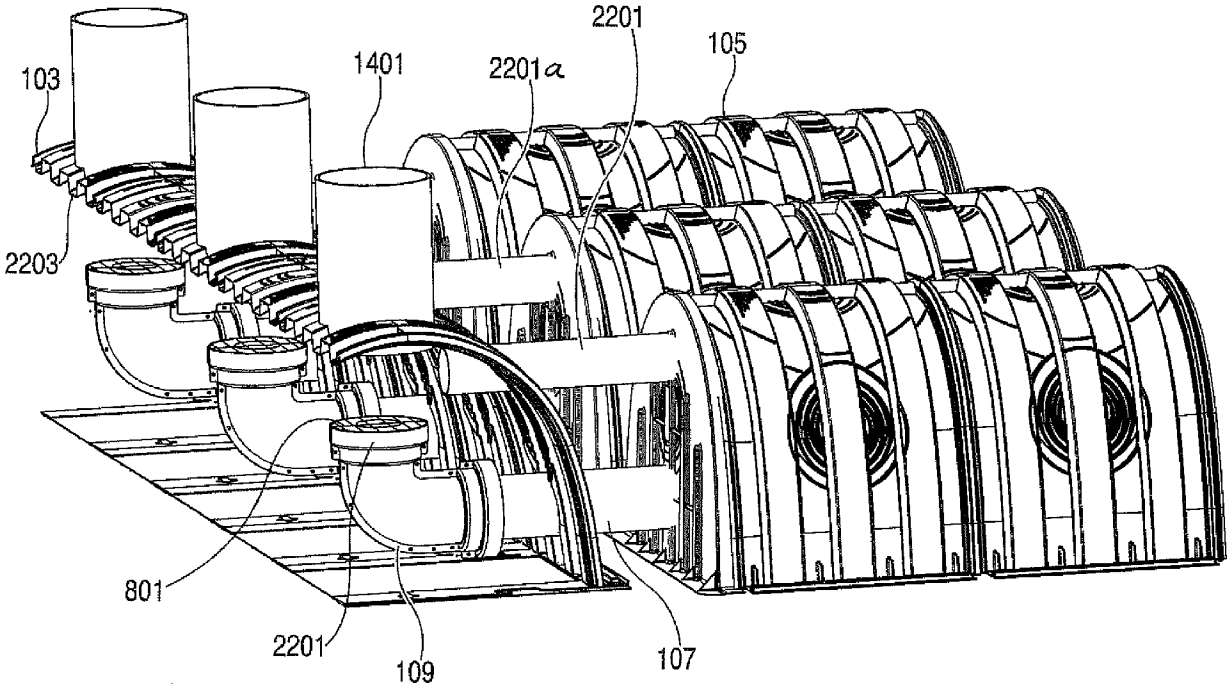
FIG. 23 shows three 90° transfer device s facing upwards towards the ceiling of the primary underground water collection and storage chamber with a surface access ports.

FIG. 22 shows a 90° angled water transfer device 109 with its inlet pointed up 2201 and facing the top 2203 of the primary underground water collection and storage chamber 103. FIG. 23 shows three 90° angled water transfer devices 109 with inlets 2201 facing upward with exemplary screens 801 contained in the inlets 2201 of the devices and an access portal 1401 located at the top of the primary underground water collection and storage chamber 103 for maintaining the inlet filters (not shown) or screens 801 from the surface. In an alternative embodiment a secondary transfer device 2201*a* might be located above the primary transfer device 107 to allow for bypass of water directly from the primary underground water collection and storage chamber 103 to the secondary underground water collection and storage chamber 105 to prevent surface flooding in high flow.

Figure 24:
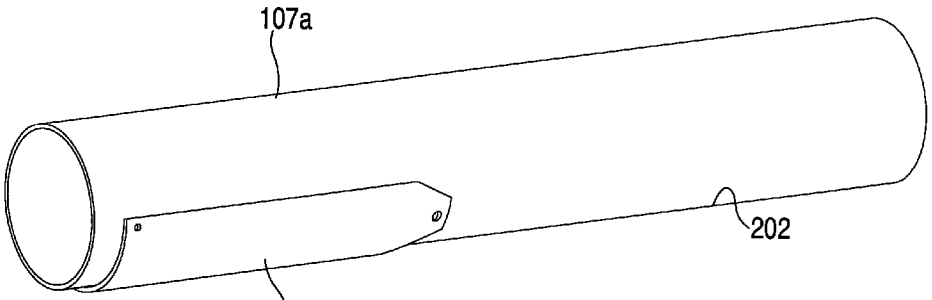
FIG. 24 shows a water transfer device with a sediment trap device located at the bottom of the pipe in a closed position.
Figure 25:
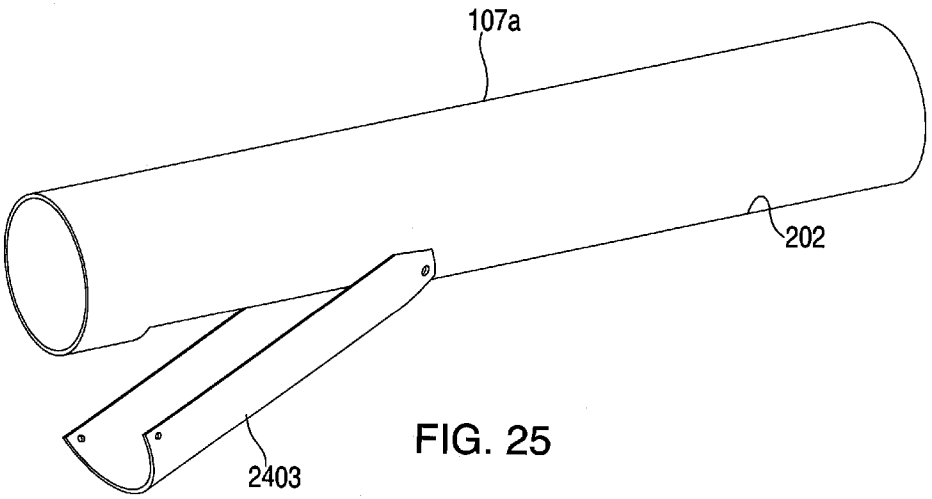
FIG. 25 shows a water transfer device with a sediment trap device located in an open position.
Figure 26:
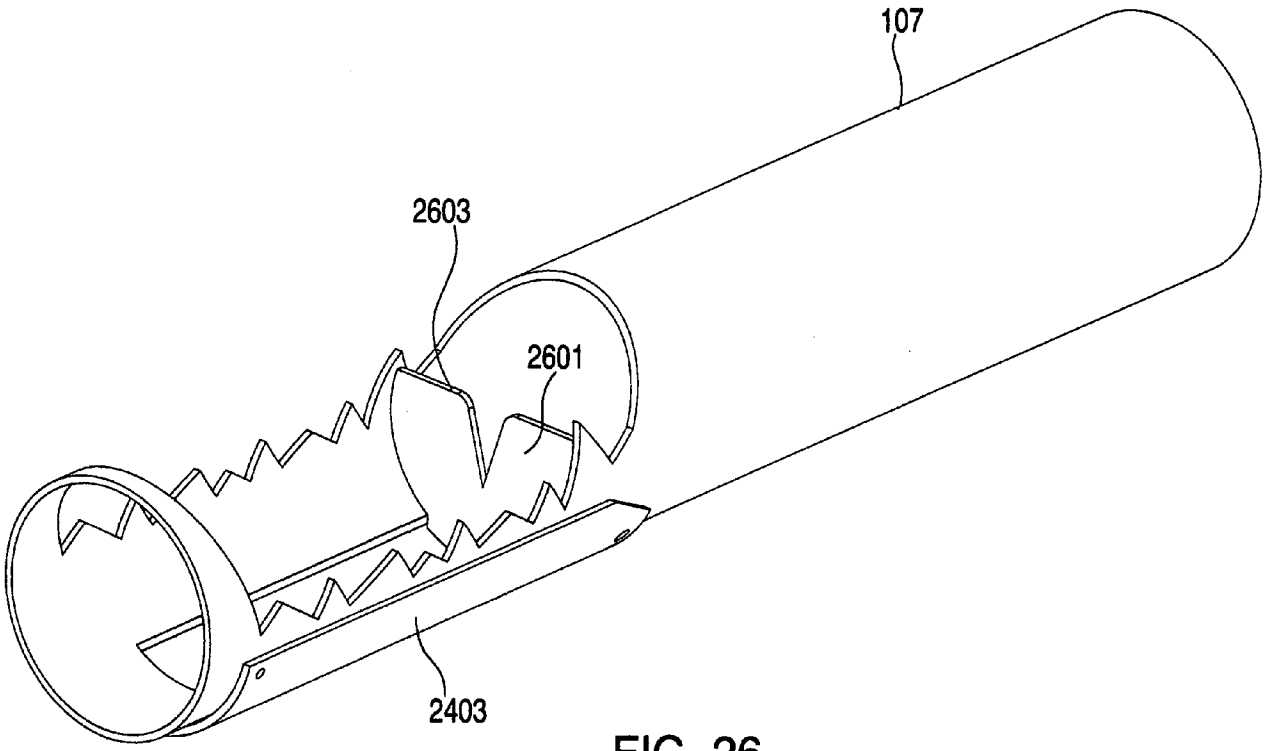
FIG. 26 shows a cutaway view of a sediment trap device with a weir component in a water transfer device.
Figure 27A:
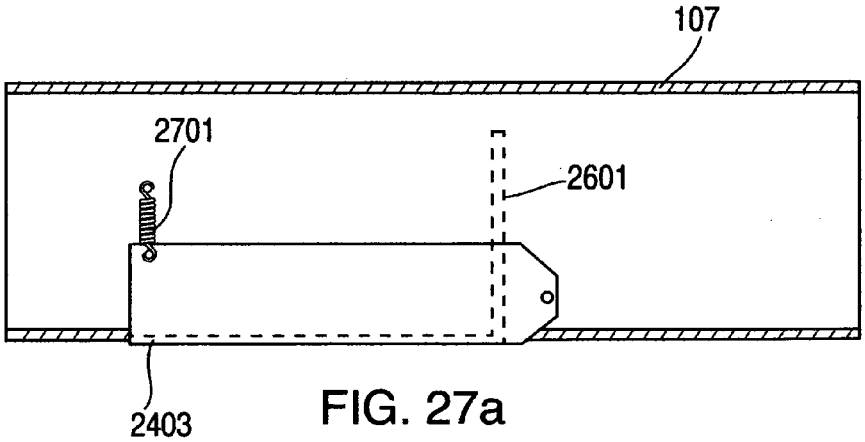
FIG. 27A shows a sediment trap device with a spring mechanism in a closed position.
Figure 27B:
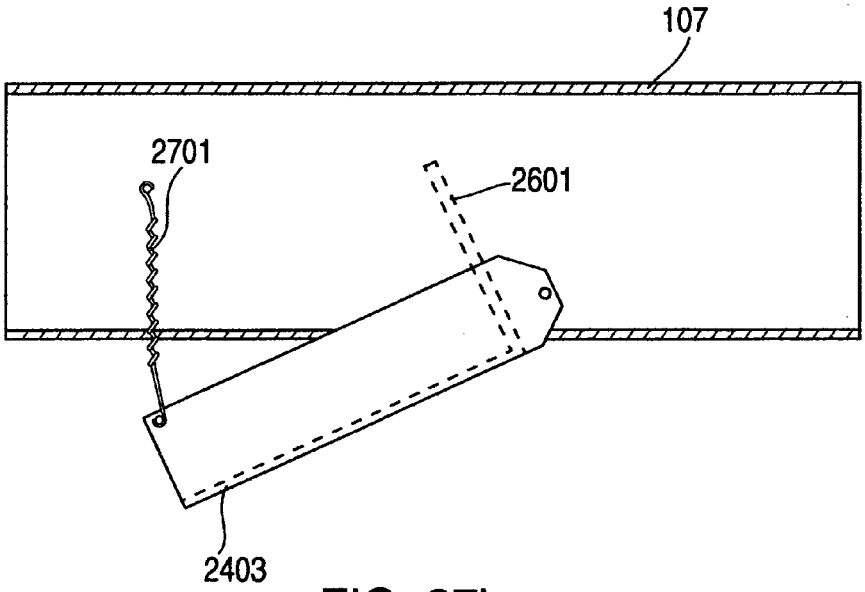
FIG. 27B shows a sediment trap device with a spring mechanism in a opened position.

In an alternative embodiment the bottom 202*n* of a water transfer device 107 might include a sediment trap device 2403 that would open downward with the presence of sediments and/or debris at a pre-designated load in the pipe 107*a* as shown in FIG. 24. FIG. 24 shows the trap 2403 in a closed position on the water transfer device, while FIG. 25 shows the trap 2403 in an open position. In one preferred embodiment as shown in FIG. 26, the transfer device 107 with a trap device 2403 might contain a weir mechanism 2601 that forces the water to flow over the top of the weir 2603 preventing sediment from entering a secondary underground water collection and storage chamber. FIGS. 27*a* and *b* show an alternative embodiment where the trap device 2403 might include a spring mechanism 2701 that allows the trap to reclose after the load is dropped.

Figure 28:
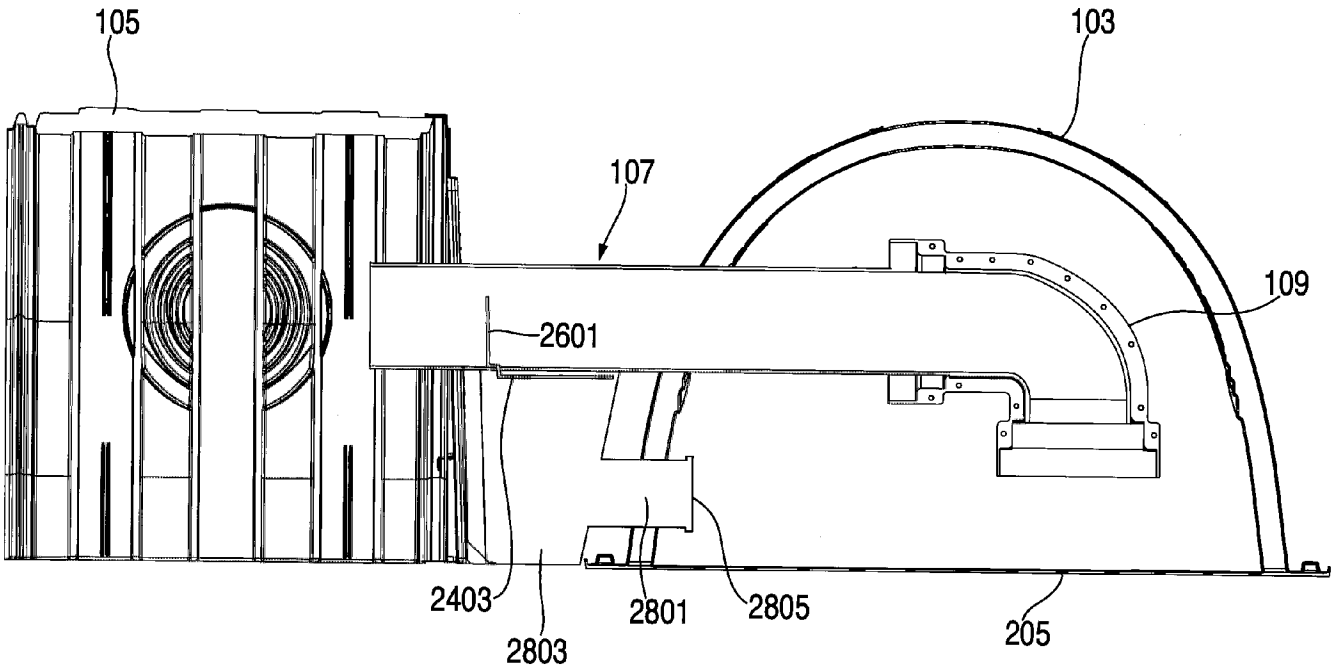
FIG. 28 shows a sediment trap door device located in the water transfer device between the primary underground water collection and storage chamber and the secondary underground water collection and storage chamber in a closed position.

In one embodiment, the primary underground collection and storage chamber 103 might include a clean out access 2801 to the area below the trap device 2403 to allow for maintenance and removal of accumulated sediments under the trap device 2403 as shown in FIG. 28. The area below the trap device 2403 might include a containment component 2803 such as, for example, a box as shown in FIG. 28. In one variation a maintenance access port 2805 from the primary underground water collection and storage chamber might be included for cleaning out the containment container 2803 from the primary chamber.

Figure 29:
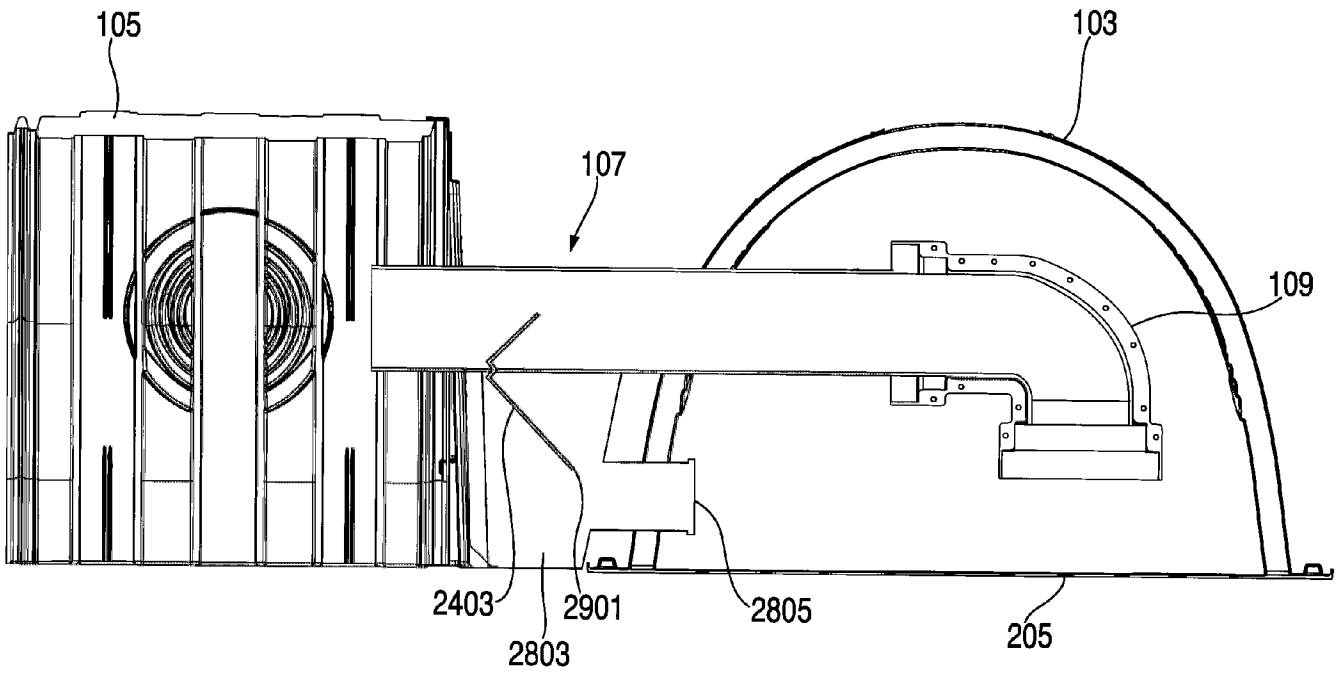
FIG. 29 shows a sediment trap device located in the water transfer device between the primary underground water collection and storage chamber and the secondary underground water collection and storage chamber in an open position.
Figure 30:
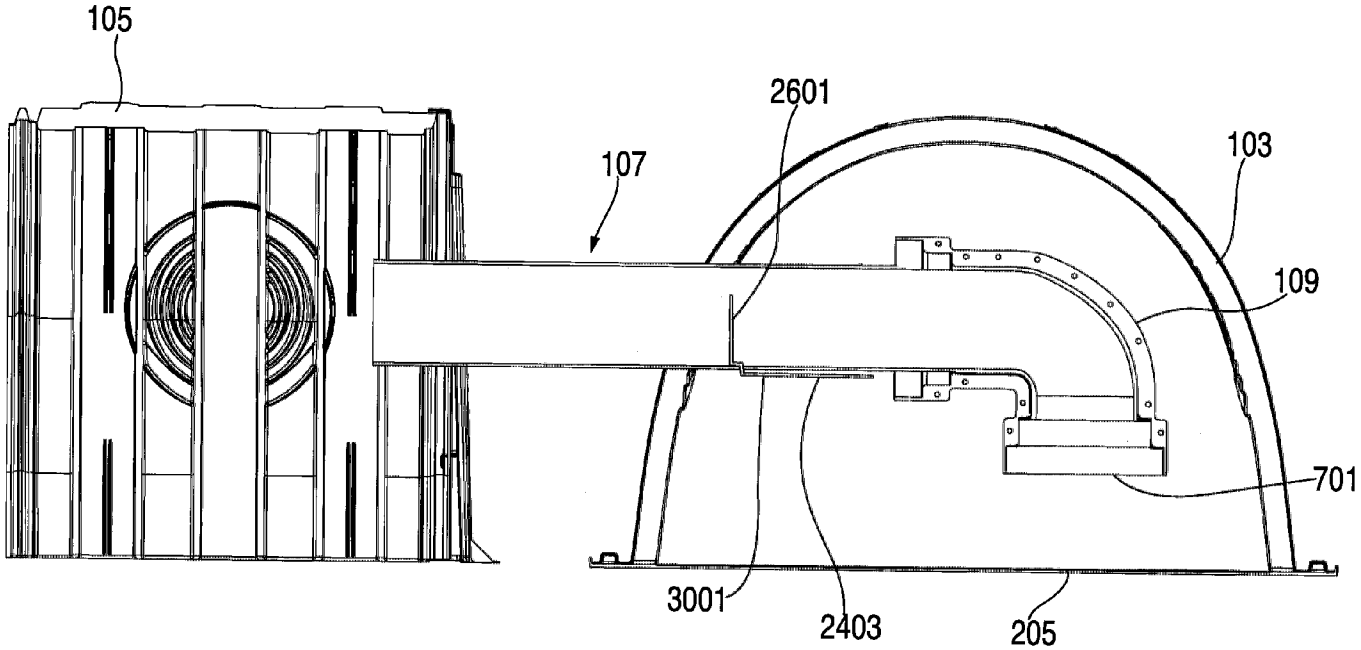
FIG. 30 shows a sediment trap device in a closed position located in the water transfer device within the primary underground water collection and storage chamber.
Figure 31:
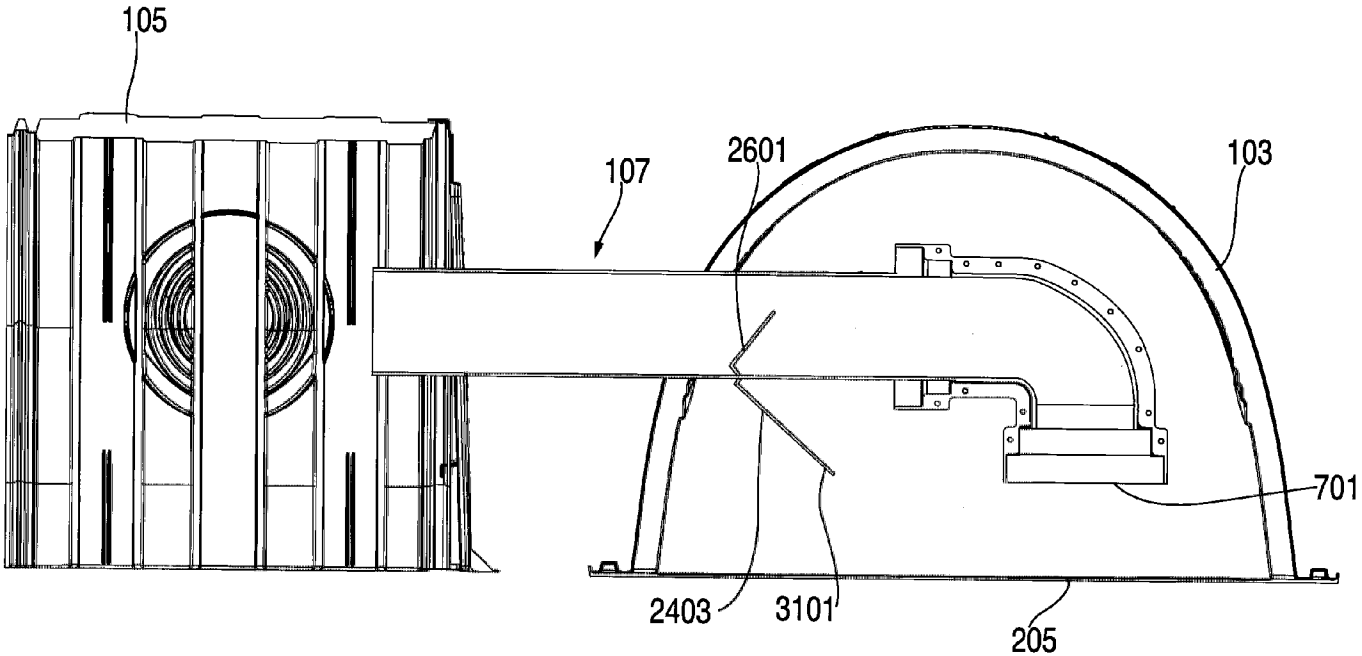
FIG. 31 shows a sediment trap device in an open position located in the water transfer device within the primary underground water collection and storage chamber.

FIG. 28 shows the trap device 2403 located in the water transfer device 107 in a closed position between the primary underground water collection and storage chamber 103 and the secondary underground water collection and storage chamber 105, while FIG. 29 shows it in an open position 2901. FIGS. 30 and 31 show an alternative where the trap device 2403 is located at the bottom of the water transfer device 107 inside the primary underground water collection and storage chamber 103. FIG. 30 shows the trap device in a closed position 3001, and FIG. 31 shows it in an open position 3101.

Figure 32:
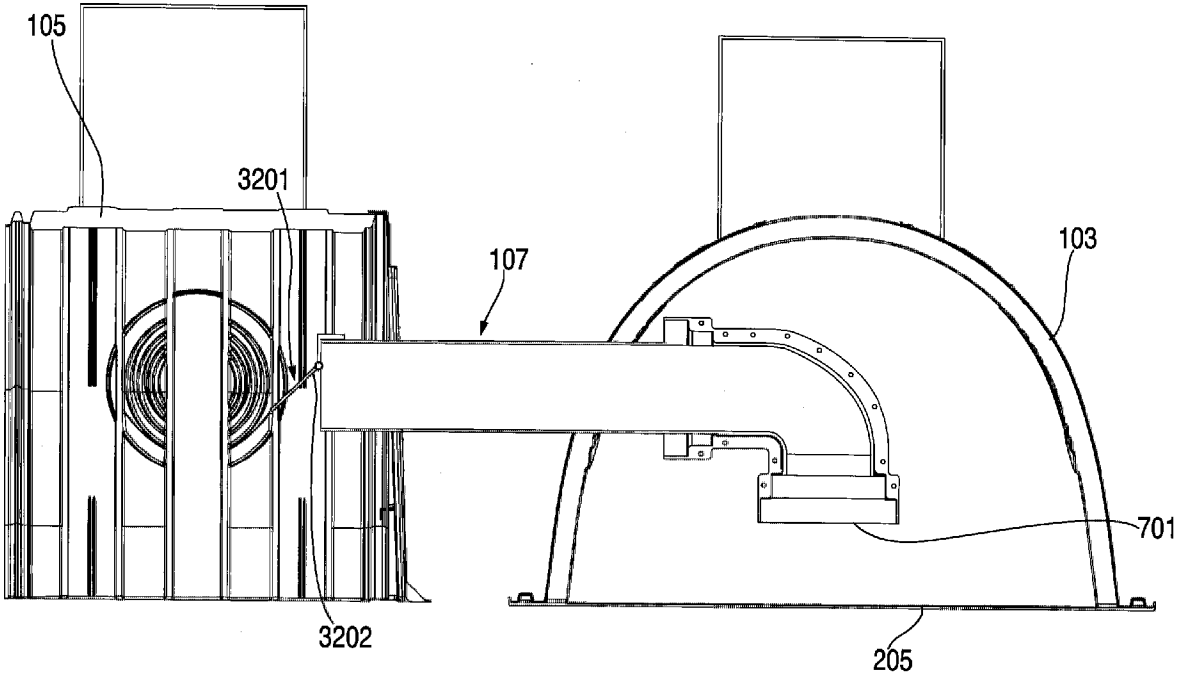
FIG. 32 shows a water transfer device with a trap door device system at the outlet of the water transfer device located in the secondary underground water collection and storage chamber for preventing back flow to the primary chamber within the trap in a open position.
Figure 33:
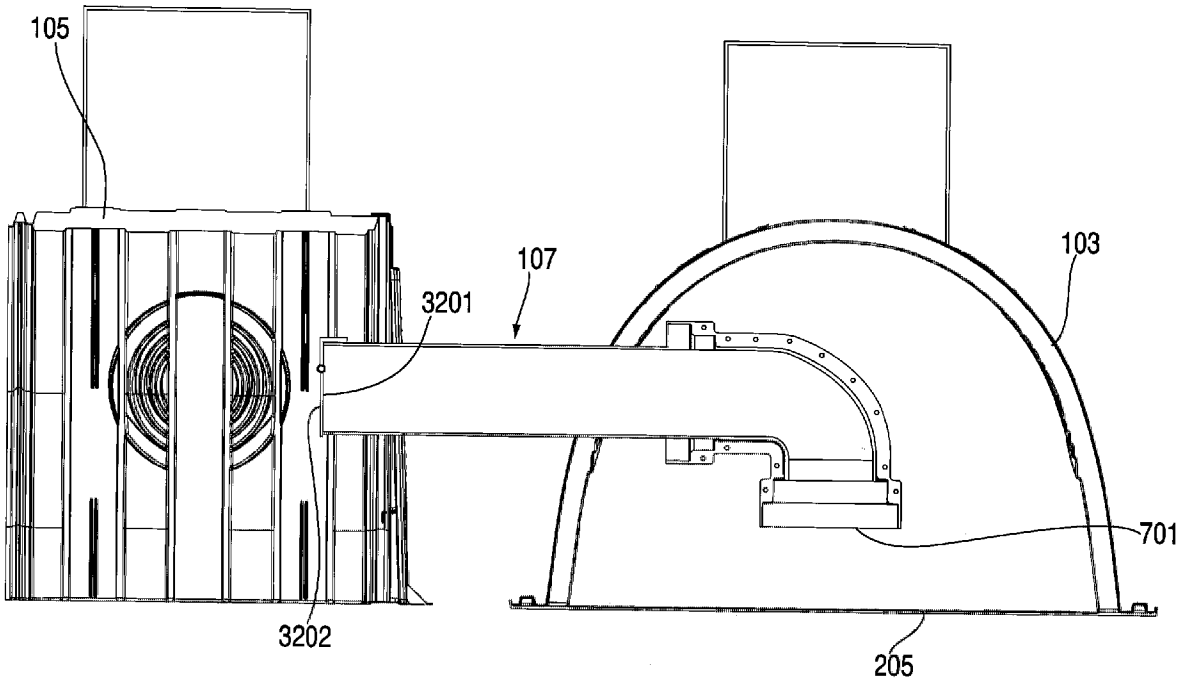
FIG. 33 shows a water transfer device with a trap door device system at the outlet of the water transfer device located in the secondary underground water collection and storage chamber or preventing back flow to the primary chamber within the trap in an closed position.

As shown in FIGS. 32 and 33, in an alternative embodiment, the water transfer device 107 might include a back flow stop mechanism 3201 that allows the water to flow into the secondary underground water collection and storage chamber 105 from the primary underground water collection and storage chamber 103, but prevents the backflow of water once the levels of flow from the primary underground water collection and storage chamber 103 are reduced. This backflow stop mechanism 3201 might include a spring trap door mechanism 3202 that closes upon reduction of flow pressure, thus preventing backflow back into the primary underground water collection and storage chamber 103.

FIG. 32 shows the backflow stop mechanism in an open position, while FIG. 33 shows it closed.

While the fundamental features of the novel nature of the invention have been disclosed herein it should be understood that various aspects of the invention may be made by those skilled in the art without departing from the spirit and scope of the invention. Accordingly, all such modifications or variations are included in the scope of the invention as defined by the claims.

What is being claimed is:

1. An underground water collection and storage system, wherein the system comprises:

a primary underground water collector having an enclosure wall, a water inlet, a floor and ends defining a primary storage chamber enclosure having a longitudinal axis;

a secondary underground water overflow collector having an enclosure wall and ends defining a secondary storage chamber enclosure; and a water transfer device for transferring excess overflow water from the primary chamber to the secondary chamber, the transfer device including:

a first elongate pipe having a first end extending through the primary collector enclosure wall and elevated above and distant from the primary chamber floor defining an elongate axis, the first elongate pipe having a first end defining a first plane substantially perpendicular to the elongate axis positioned in the primary storage chamber and an outlet end positioned and longitudinally extending into the secondary storage chamber having a lowest portion;

an angled inlet elbow positioned in the primary storage chamber extending from the elongate pipe first end, the inlet elbow having an inlet end defining an inlet opening in an inlet plane angularly displaced relative to the elongate pipe first plane and elevated above and distant from the primary chamber floor to restrict the passage of debris in the water from the primary chamber to the secondary chamber as overflow water in the primary chamber rises above the elbow inlet opening;

at least a first water transfer device and a second water transfer device separated along the primary storage chamber longitudinal axis, wherein the first transfer device elbow inlet plane is positioned at a first elevational height relative to the primary storage chamber floor and the second transfer device elbow inlet end is positioned at a second elevational height relative to the primary chamber floor, wherein the first transfer device inlet plane first height is elevationally lower than the second transfer device inlet plane second height, the higher second transfer device serving as a secondary auxiliary bypass, the first transfer device lower inlet operable to first direct the flow of overflow water through the lower first transfer device inlet from the primary chamber to a selected secondary chamber prior to overflow water passing through the second transfer device; and the higher second water transfer device elbow inlet plane is positioned substantially perpendicular to the primary storage chamber longitudinal axis.

2. The system of claim 1 wherein the angled elbow inlet plane is oriented toward the primary chamber floor and positioned below the outlet end lowest portion.

3. The system of claim 1 wherein the inlet plane is positioned at an angle about 90° relative to the elongate pipe first plane.

4. The system of claim 3 wherein the inlet plane is positioned substantially parallel to the primary storage chamber floor.

5. The system of claim 4 wherein the elbow inlet plane is positioned elevationally above a highest portion of the elongate pipe outlet end.

6. The system of claim 1 wherein one of the first or the second transfer device elbow inlet end further comprises a filter cartridge positioned in the inlet opening.

7. The system of claim 6 wherein the inlet end of one of the first or the second transfer devices further comprises a radially enlarged portion defining an increased inlet end and inlet opening; and the filter cartridge positioned in the enlarged inlet opening substantially flush with the inlet plane.

8. The system of claim 1 wherein the first transfer device elbow defines a second inlet bypass opening positioned elevationally above the inlet end opening in fluid communication with the elongate pipe, the second inlet bypass opening providing a second fluid inlet opening to maintain fluid flow to the secondary chamber if the first inlet opening becomes obstructed or fluid flow exceeds the capacity of the first inlet.

9. The system of claim 1 wherein the first transfer device inlet plane is positioned at a different angle relative to the respective elongate pipe first plane than the second transfer device inlet plane is positioned relative to the respective elongate pipe first plane.

10. The system of claim 1 wherein the transfer device comprises a first transfer device, the system further comprising:

a second transfer device defining an second elongate pipe positioned elevationally above the first elongate pipe and defining a second inlet opening extending into the primary storage chamber and an outlet end positioned in the secondary storage chamber, wherein a lowest portion of secondary transfer device second inlet opening is positioned elevationally higher than a highest portion of the first transfer device inlet opening, the second inlet opening serving as a secondary auxiliary bypass for the flow of fluid from the primary chamber to the secondary chamber.

11. An underground water collection and storage system, the system comprising:

a primary underground water collection and storage chamber;

a secondary underground water collect and storage chamber;

a water transfer device in fluid communication with the primary chamber and the secondary chamber, the transfer device including a substantially horizontal pipe elevated above a floor of the principal chamber having an elongate axis, an inlet end positioned in the primary storage chamber and an outlet end positioned in the secondary storage chamber, the pipe defining a sediment opening in a bottom of the pipe positioned between and distant from the inlet and the outlet ends;

a sediment trap door connected to the pipe adjacent the sediment opening having a normally-biased closed position preventing sediment from passing through the sediment opening and an open position permitting the flow of sediment through the sediment opening; and a biasing member connected to the pipe and the trap door to provide a resistive force against the trap door moving from the closed position to the open position, the sediment trap door operable to automatically move between the normally biased closed position to the open position on a predetermined weight of sediment settling on the door and overcoming the resistive force to open the trap door to prevent excess sediment from entering the secondary storage chamber, the trap door automatically returning to the close position on exiting of the sediment from the trap door under gravitational force.

12. The assembly of claim 11 wherein the sediment trap door biasing member comprises a spring.

13. The assembly of claim 11 wherein the water transfer device includes a weir connected to a downstream portion of the door to concentrate the collection of sediment on the trap door.

14. The system of claim 11 wherein the transfer device pipe sediment opening is positioned within the primary storage chamber, wherein on movement of the door from the normally-biased closed position to the open position the sediment is deposited within the primary storage chamber.

15. The system of claim 11 wherein the transfer device pipe sediment opening is positioned between the primary storage chamber and the secondary storage chamber, the system further comprising a separate sediment container positioned below the sediment trap door positioned between the primary and the secondary storage chambers and having access for sediment removal, wherein on passage of sediment through the sediment trap door, sediment is deposited in the sediment container for selected removal.

16. The system of claim 11 further comprising a backflow door positioned proximate the outlet end of the transfer device elongate pipe, the backflow door operable to substantially prevent water from flowing from the secondary storage chamber to the primary storage chamber.

17. An underground water collection and storage system, the system comprising:

a primary underground water collection and storage chamber having a floor;

a plurality of secondary underground water collection and storage chamber;

a plurality of water transfer devices in fluid communication with the primary chamber and the secondary chamber, each transfer device including:

an elevated elongate pipe positioned above and distant from the primary chamber floor, the pipe having an axis a first end defining a first plane substantially perpendicular to the pipe axis positioned in the primary storage chamber and an outlet end positioned in the secondary storage chamber;

at least one of the transfer devices including an inlet elbow connected to the respective pipe first end, the inlet elbow having an inlet end defining an inlet opening in an inlet plane angularly oriented at about a 90 degree angle relative to the pipe first plane;

a sediment management device positioned in the transfer device pipe for controlling settlement buildup and selected removal of sediment deposits from the system, the sediment management device comprising:

a multi-tiered filter cartridge positioned within each transfer pipe inlet opening;

the transfer device pipe defining a sediment opening in a bottom of the pipe positioned between the inlet opening and the outlet, a sediment trap door hingedly connected to the pipe adjacent the sediment opening having a normally-biased closed position preventing sediment from passing through the sediment opening and an open position permitting the flow of sediment through the sediment opening;

a spring biasing member connected to the elongate pipe and the trap door to continuously provide a resistive force against the trap door moving from the normally-biased closed position to the open position, the sediment trap door operable to move between the normally biased closed position to the open position on a predetermined weight of sediment settling on the door and overcoming the resistive force to open the trap door to prevent excess sediment from entering the secondary storage chamber;

an weir connected to a downstream portion of the trap door and extending upward into the elongate pipe to concentrate the collection of sediment on the trap door to facilitate removal of sediment prior to reaching the secondary chamber; and a backflow door positioned proximate the outlet of the transfer device pipe, the backflow door operable to substantially prevent water from flowing from the secondary storage chamber to the primary storage chamber.

* * * * *